US012735826B2

(12) United States Patent
Zhao et al.

(10) Patent No.: US 12,735,826 B2
(45) Date of Patent: Sep. 15, 2026

(54) LAUNDRY TREATMENT DEVICE AND CONTROL METHOD FOR LAUNDRY TREATMENT DEVICE

(71) Applicants: QINGDAO HAIER LAUNDRY ELECTRIC APPLIANCES CO., LTD, Qingdao (CN); Haier Smart Home Co., Ltd., Qingdao (CN)

(72) Inventors: Zhiqiang Zhao, Qingdao (CN); Sheng Xu, Qingdao (CN); Wenwei Li, Qingdao (CN)

(73) Assignees: QINGDAO HAIER LAUNDRY ELECTRIC APPLIANCES CO., LTD, Qingdao (CN); Haier Smart Home Co., Ltd., Qingdao (CN)

( * ) Notice: Subject to any disclaimer, the term of this patent is extended or adjusted under 35 U.S.C. 154(b) by 115 days.

(21) Appl. No.: 18/730,879

(22) PCT Filed: Jan. 6, 2023

(86) PCT No.: PCT/CN2023/070853
§ 371 (c)(1),
(2) Date: Jul. 22, 2024

(87) PCT Pub. No.: WO2023/138401
PCT Pub. Date: Jul. 27, 2023

(65) Prior Publication Data

US 2025/0101657 A1 Mar. 27, 2025

(30) Foreign Application Priority Data

Jan. 20, 2022 (CN) ..... 202210066935.4
Jan. 20, 2022 (CN) ..... 202210068148.3
Jan. 20, 2022 (CN) ..... 202210068158.7

(51) Int. Cl.
*D06F 35/00* (2006.01)
*D06F 33/32* (2020.01)

(52) U.S. Cl.
CPC ..... *D06F 35/002* (2013.01); *D06F 33/32* (2020.02)

(58) Field of Classification Search
CPC ..... D06F 17/12; D06F 21/02; D06F 21/04; D06F 23/02; D06F 23/025; D06F 33/32;
(Continued)

(56) References Cited

FOREIGN PATENT DOCUMENTS

CN 2257298 Y 7/1997
CN 1156193 A 8/1997
(Continued)

OTHER PUBLICATIONS

Machine Translation of Zhang et al., CN-205115867-U, Mar. 2016. (Year: 2016).*

(Continued)

*Primary Examiner* — David G Cormier
(74) *Attorney, Agent, or Firm* — Maier & Maier, PLLC

(57) ABSTRACT

A laundry treatment device and a control method for the laundry treatment device aim to solve the problems that improvements are required in existing washing machines for removing stains from laundry and the dissolving effect of a detergent. The laundry treatment device includes: an inner drum, the inner drum provided with a vent; a ventilation member, the ventilation member including an air inlet and an air outlet; and a gas generating device, the gas generating device comprising a gas outlet, where the gas outlet communicates with the air inlet, and gas generated by the gas generating device passes from the air outlet and through the ventilation hole, and enters a water storage area of the inner drum. According to the arrangement, dirt on the laundry can be efficiently stripped, the amount of detergent used and
(Continued)

residues are reduced, and the dirt removal dissolving effect of the detergent are improved.

8 Claims, 5 Drawing Sheets

(58) Field of Classification Search
CPC ..... D06F 33/63; D06F 33/64; D06F 35/001; D06F 35/002; D06F 2105/32
See application file for complete search history.

(56) References Cited

FOREIGN PATENT DOCUMENTS

| | | | | |
|---|---|---|---|---|
| CN | 105256509 | A | | 1/2016 |
| CN | 205115867 | U | * | 3/2016 |
| CN | 105951348 | A | | 9/2016 |
| CN | 106381632 | A | | 2/2017 |
| CN | 106381638 | A | | 2/2017 |
| CN | 106381642 | A | | 2/2017 |
| CN | 106400374 | A | | 2/2017 |
| CN | 206189086 | U | | 5/2017 |
| CN | 206189087 | U | | 5/2017 |
| CN | 206189102 | U | | 5/2017 |
| CN | 206256278 | U | | 6/2017 |
| CN | 207391830 | U | | 5/2018 |
| CN | 109972341 | A | | 7/2019 |
| CN | 111041763 | A | | 4/2020 |
| CN | 214300813 | U | | 9/2021 |
| CN | 113756057 | A | | 12/2021 |
| CN | 114717787 | A | | 7/2022 |
| JP | H067591 | A | | 1/1994 |
| JP | 2014158599 | A | | 9/2014 |
| JP | 2019097965 | A | | 6/2019 |
| WO | 2020106063 | A1 | | 5/2020 |

OTHER PUBLICATIONS

International Search Report issued on Mar. 27, 2023, in corresponding International Application No. PCT/CN2023/070853; 6 pages.
Office Action issued on Nov. 18, 2025, in corresponding Chinese Application No. 202210066935.4, 19 pages.
Decision to Grant issued on Jan. 9, 2026, in corresponding Chinese Application No. 202210068158.7, 10 pages.
Decision to Grant issued on Jan. 9, 2026, in corresponding Chinese Application No. 202210068148.3, 10 pages.

* cited by examiner

LAUNDRY TREATMENT DEVICE AND CONTROL METHOD FOR LAUNDRY TREATMENT DEVICE

CROSS-REFERENCE TO RELATED APPLICATIONS

The present application claims priority from Chinese patent applications No. CN202210068158.7, CN202210068148.3, and CN202210066935.4 filed on Jan. 20, 2022, the entire disclosure of which is incorporated herein by reference.

FIELD

The present disclosure relates to the field of clothing treatment apparatus, and specifically provides a clothing treatment apparatus, and a control method for a clothing treatment apparatus.

BACKGROUND

The existing washing machines usually achieve the purpose of removing stains from clothing by adding a detergent. The detergent removes stains mainly through its chemical composition. Whether the detergent can be fully dissolved affects a washing effect of the clothing. If the detergent cannot be fully dissolved, it will remain on the clothing, causing damage to the clothing.

In the prior art, in order to accelerate the dissolution of detergent and remove stains from the clothing, a gas generation device is usually introduced. A gas vent of the gas generation device is arranged between inner and outer cylinders. For example, the gas generation device is directly arranged on an inner side wall of the outer cylinder, and bubbles generated at a gas vent are directly emitted between the inner and outer cylinders. Alternatively, the gas generation device is arranged outside the outer cylinder, and the bubbles are introduced between the inner and outer cylinders through pipelines. Then, the bubbles enter the inner cylinder through water permeable holes of the inner cylinder. However, the above arrangement has limited effect on the dissolution of detergent and the removal of stains on the clothing.

In order to solve the above problems, existing improvement solutions are all aimed at improving the gas generation device or related pipelines, so that enough bubbles are generated at the gas vent, or micro bubbles are generated. Although the removal of clothing stains and the solubility of detergent are slightly improved, the effect is not yet to user's satisfaction.

Accordingly, there is a need in the art for a new clothing treatment apparatus and a control method for a clothing treatment apparatus to solve the problems of existing washing machines that the removal of clothing stains and the dissolution effect on detergent need to be significantly improved.

SUMMARY

The present disclosure aims to solve the above technical problems, that is, to solve the problems of existing washing machines that the removal of clothing stains and the dissolution effect on detergent need to be significantly improved.

In a first aspect, the present disclosure provides a clothing treatment apparatus, which includes: an inner cylinder, on which a ventilation hole is provided; a ventilation member, which includes a gas inlet and a gas outlet; and a gas generation device, which includes a gas vent; the gas vent is communicated with the gas inlet, and gas generated by the gas generation device enters a water storage area of the inner cylinder through the ventilation hole from the gas outlet.

In a preferred technical solution of the clothing treatment apparatus described above, the clothing treatment apparatus further includes a driving device, which is connected to the ventilation member; the ventilation member can extend and retract on inner and outer sides of the ventilation hole when driven by the driving device; and when the ventilation member extends into the inner side of the ventilation hole, the gas outlet is located in the water storage area.

In a preferred technical solution of the clothing treatment apparatus described above, a lifting rib is provided on an inner side wall of the inner cylinder, and a first through hole is provided on the lifting rib; the lifting rib and the inner side wall enclose a chamber, in which the ventilation hole is located.

In a preferred technical solution of the clothing treatment apparatus described above, the ventilation member is a rod, and an airflow channel is formed inside the rod in its axial direction; the gas inlet and the gas outlet are both communicated with the airflow channel; the driving device includes a motor and a transmission assembly, and the motor is connected to the rod through the transmission assembly.

In a preferred technical solution of the clothing treatment apparatus described above, a first installation hole is provided on an outer cylinder of the clothing treatment apparatus, and the clothing treatment apparatus further includes a sealing member; the sealing member includes a flexible cover, a bottom end of the flexible cover has an opening, and the opening is sealingly connected to the first installation hole; a top end of the flexible cover is provided with a second installation hole; a first end of the rod is connected to the transmission assembly, a second end of the rod is arranged in such a way that it passes through the second installation hole from an interior of the flexible cover, and the second installation hole is fixedly and sealingly connected to the rod; when the driving device drives the rod to extend into the inner side of the ventilation hole, the flexible cover can form a seal with the ventilation hole.

In a preferred technical solution of the clothing treatment apparatus described above, the sealing member further includes a casing having an opening at a top end, and a bottom end of the casing is sealingly installed in the first installation hole; the bottom end of the flexible cover is connected to an inner bottom wall of the casing, and the top end of the flexible cover is sealingly connected to the opening; a second through hole is also formed on the bottom wall of the casing, and the second through hole is located in the flexible cover; the rod passes through the second through hole and leaves a free gap with the second through hole; and/or the transmission assembly is a cam and connecting rod mechanism.

In a preferred technical solution of the clothing treatment apparatus described above, the ventilation member is a corrugated pipe, and a pressure chamber is formed inside a pipe wall of the corrugated pipe; a pressure port is provided on the pipe wall, and the pressure port is communicated with the pressure chamber; the driving device is a pneumatic or hydraulic device, an outlet of the driving device is communicated with the pressure port, and one end of the corrugated pipe is communicated with the gas vent.

In a preferred technical solution of the clothing treatment apparatus described above, the clothing treatment apparatus further includes a position sensing device which is set to be triggered when the inner cylinder rotates to a set position, so as to control the inner cylinder to stop rotating, so that after the inner cylinder stops rotating, the gas generated by the gas generation device can enter the water storage area of the inner cylinder through the ventilation hole from the gas outlet.

In a preferred technical solution of the clothing treatment apparatus described above, the gas outlet is located between the inner cylinder and the outer cylinder of the clothing treatment apparatus, and is arranged corresponding to the ventilation hole.

In another aspect, the present disclosure also provides a control method for a clothing treatment apparatus, in which the clothing treatment apparatus includes: an inner cylinder, on which a ventilation hole is provided; a ventilation member, which includes a gas inlet and a gas outlet; and a gas generation device, which includes a gas vent; the gas vent is communicated with the gas inlet, and gas generated by the gas generation device enters a water storage area of the inner cylinder through the ventilation hole from the gas outlet; and the control method includes: controlling the inner cylinder to rotate during a washing process; controlling the inner cylinder to stop rotating when the inner cylinder rotates to a set position; and controlling the gas generation device to turn on.

It can be understood that the clothing treatment apparatus of the present disclosure includes: an inner cylinder, on which a ventilation hole is provided; a ventilation member, which includes a gas inlet and a gas outlet; a gas generation device, which includes a gas vent; the gas vent is communicated with the gas inlet, and gas generated by the gas generation device enters a water storage area of the inner cylinder through the ventilation hole from the gas outlet.

In the present application, by providing the ventilation hole on the inner cylinder, the gas generated by the gas generation device directly enters the water storage area of the inner cylinder through the ventilation hole. High energy bubbles are formed in the washing/rinsing water, leading to the formation of a large number of cavitation bubbles in the water. Hundreds of billions of rigid bubbles burst, immediately generating a strong impact force, efficiently removing dirt and stains from the clothing, reducing the usage amount and residue of detergent, and significantly improving the effects of stain removal and detergent dissolution.

BRIEF DESCRIPTION OF DRAWINGS

Preferred embodiments of the present disclosure will be described below in connection with the accompanying drawings, in which.

DETAILED DESCRIPTION

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure. The embodiments can be adjusted by those skilled in the art as required so as to adapt to specific application scenes.

It should be noted that in the description of the present disclosure, terms indicating directional or positional relationships, such as "top", "bottom" and the like, are based on the directional or positional relationships shown in the accompanying drawings. They are only used for ease of description, and do not indicate or imply that the device or element must have a specific orientation, or must be constructed or operated in a specific orientation; therefore, they should not be considered as limitations to the present disclosure. In addition, terms "first" and "second" are only used for descriptive purpose, and should not be understood as indicating or implying relative importance.

In addition, it should also be noted that in the description of the present disclosure, unless otherwise clearly specified and defined, terms "install", "connect", "connection" and "communicate" should be understood in a broad sense; for example, the connection may be a fixed connection, or a detachable connection, or an integral connection; it may be a direct connection, or an indirect connection implemented through an intermediate medium. For those skilled in the art, the specific meaning of the above terms in the present disclosure can be interpreted according to specific situations.

Figure 1:
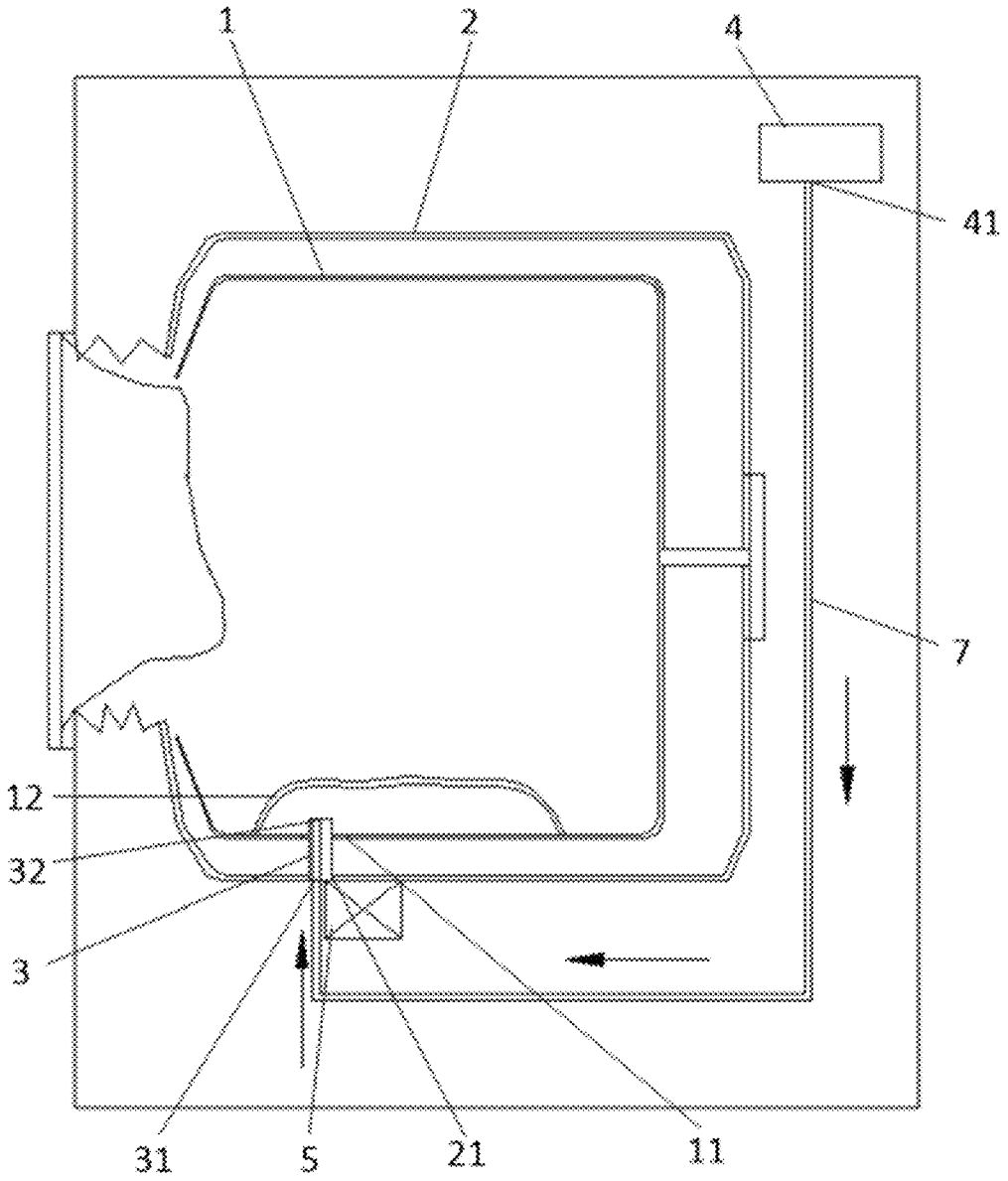
FIG. 1 is a schematic structural view of the clothing treatment apparatus and the control method for the clothing treatment apparatus of the present disclosure.

As shown in FIG. 1, in order to solve the problems of existing washing machines that the removal of clothing stains and the dissolution effect on detergent need to be significantly improved, the clothing treatment apparatus of the present disclosure includes: an inner cylinder 1, on which a ventilation hole 11 is provided; a ventilation member 3, which includes a gas inlet 31 and a gas outlet 32; a gas generation device 4, which includes a gas vent 41; the gas vent 41 is communicated with the gas inlet 31, and gas generated by the gas generation device 4 enters a water storage area of the inner cylinder 1 through the ventilation hole 11 from the gas outlet 32.

There are various types of the specific forms of the gas generation device 4. For example, the gas generation device 4 can be an air pump, a fan, or a compressor, etc., which can be arranged on an inner wall of a housing of the clothing treatment apparatus, or on an outer wall of an outer cylinder 2 of the clothing treatment apparatus, etc. Preferably, the gas generation device 4 is arranged at a position higher than a liquid level in the water storage area, such as at the top of the inner wall of the housing, so as to prevent liquid from flowing back into the gas generation device 4. Of course, a waterproof and gas permeable film can be arranged at a position such as the gas outlet 32 of the ventilation member 3, which allows gas to be discharged from the gas outlet 32, but does not allow washing water to enter the ventilation member 3 from the gas outlet 32. The waterproof and gas permeable film can be a polytetrafluoroethylene film sheet or a PTFE film, etc. In this case, the position at which the gas generation device 4 is arranged on the housing and the outer cylinder 2 is not limited; the gas vent 41 of the gas generation device 4 can be connected to the gas inlet 31 of the ventilation member 3 through a connecting pipe 7, or directly connected to the gas inlet 31 of the ventilation member 3. There are various ways to introduce gas into the gas generation device 4. For example, when the gas generation device 4 is arranged on the outer side wall of the outer cylinder 2, a gas entrance of the gas generation device 4 can be connected to a hole provided on the housing of the clothing treatment apparatus through a pipe; and when the gas generation device 4 is arranged on the inner wall of the housing, the gas entrance of the gas generation device 4 can be directly connected to the hole provided on the housing, etc.

In addition, there are various types of the specific forms of the clothing treatment apparatus of the present disclosure, such as drum washing machines, pulsator washing machines, washing-drying integrated machines, etc. The water storage area is an area of the inner cylinder 1 configured to accommodate washing water. When the clothing treatment apparatus is a drum washing machine, the water storage area is located on a radial bottom side of the inner cylinder 1, and when the clothing treatment apparatus is a pulsator washing machine, the water storage area is located on an axial bottom side of the inner cylinder 1.

In addition, it can be understood that the ventilation hole 11 is different from a water permeable hole on the inner cylinder 1, and its diameter is much larger than that of the water permeable hole. The gas generated by the gas generation device 4 should be able to completely or mostly enter the water storage area of the inner cylinder 1 through the ventilation hole 11. In addition, the ventilation hole 11 is also not a clothing throw-in port on the inner cylinder 1, and the generated gas enters the water storage area of the inner cylinder 1 through the ventilation hole 11. Compared to a case where the generated gas enters the water storage area of the inner cylinder 1 through the clothing throw-in port, there is no interference problem when putting in or taking out the clothing.

Since bubbles generated at the gas vent 41 of the gas generation device 4 in the prior art are directly emitted between the inner cylinder 1 and the outer cylinder 2, the dissolution of detergent and the effect of removing stains from the clothing are limited. For improvement, the solution is usually to increase the gas volume of the gas generation device 4, or modify the gas generation device 4 to produce micro bubbles, etc., but the final use effect is not significantly improved.

The applicant has found through research that the probability of bubbles entering the inner cylinder 1 through the water permeable hole on the inner cylinder 1 from the outer cylinder 2 is very low, and experiments have shown that it is very difficult for very small micro bubbles, even if not large bubbles, to effectively enter the inner cylinder 1. That is, the applicant has found that the main reason for the poor effects of dissolving the detergent and removing stains from the clothing is not the amount of bubbles generated or the size of the bubbles generated, but rather lies in that the water permeable hole on the inner cylinder 1 makes it impossible for bubbles to effectively enter the inner cylinder 1.

Based on the above problems not discovered by those skilled in the art, in the present application, by providing the ventilation hole 11 on the inner cylinder 1, the gas generated by the gas generation device 4 directly enters the water storage area of the inner cylinder 1 through the ventilation hole 11. High energy bubbles are formed in the washing/rinsing water, leading to the formation of a large number of cavitation bubbles in the water. Hundreds of billions of rigid bubbles burst, immediately generating a strong impact force, efficiently removing dirt and stains from the clothing, reducing the usage amount and residue of detergent, and significantly improving the effects of stain removal and detergent dissolution.

In order to prevent the ventilation member 3 from interfering with the rotation of the inner cylinder 1, which will further affect the washing process, the following two possible embodiments are adopted in the present disclosure.

In a first possible embodiment, the clothing treatment apparatus further includes a driving device 5, which is connected to the ventilation member 3. The ventilation member 3 can extend and retract on inner and outer sides of the ventilation hole 11 when driven by the driving device 5; and when the ventilation member 3 extends into the water storage area of the inner cylinder 1 from the ventilation hole 11, the gas outlet 32 of the ventilation member 3 is located in the water storage area of the inner cylinder 1. That is, when it is necessary to introduce gas into the water storage area of the inner cylinder 1, the driving device 5 drives the ventilation member 3 to extend into the water storage area of the inner cylinder 1, and the gas discharged from the gas outlet 32 can be directly introduced into the water storage area, so that the energy generated by the bubbles is fully utilized and the washing effect is improved. When it is not necessary to introduce gas into the water storage area of the inner cylinder 1, the driving device 5 drives the ventilation member 3 to retract from the water storage area of the inner cylinder 1 to the outside of the inner cylinder 1 to avoid interference with the rotation of the inner cylinder 1.

Figure 2:
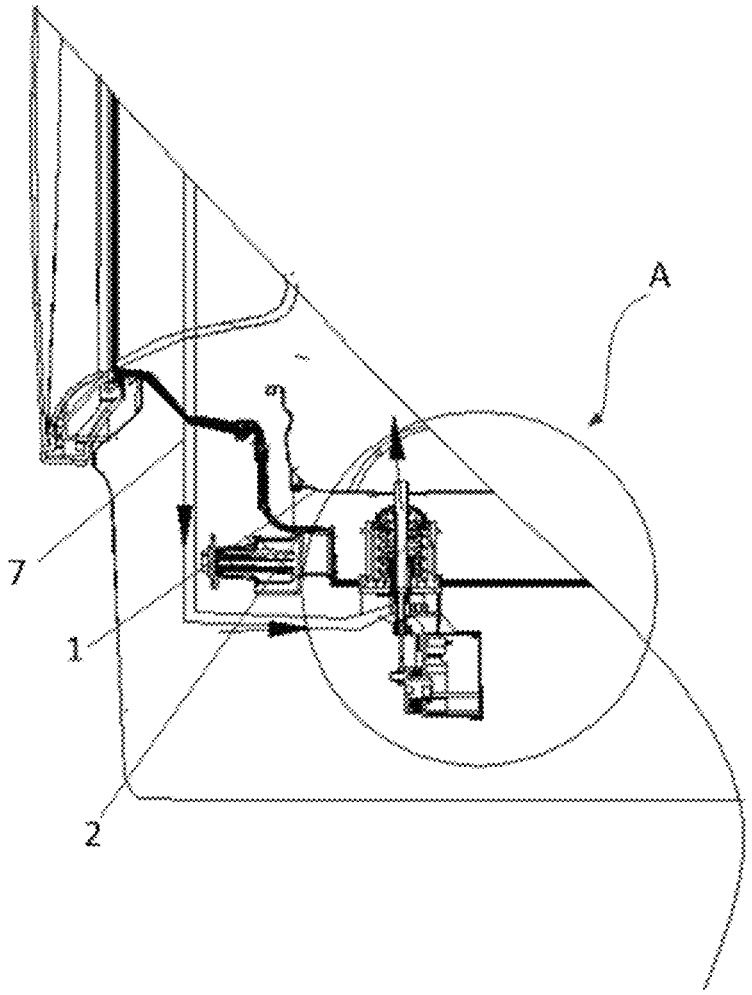
FIG. 2 is a first schematic structural view of a possible embodiment of the clothing treatment apparatus and the control method for the clothing treatment apparatus of the present disclosure.
Figure 3:
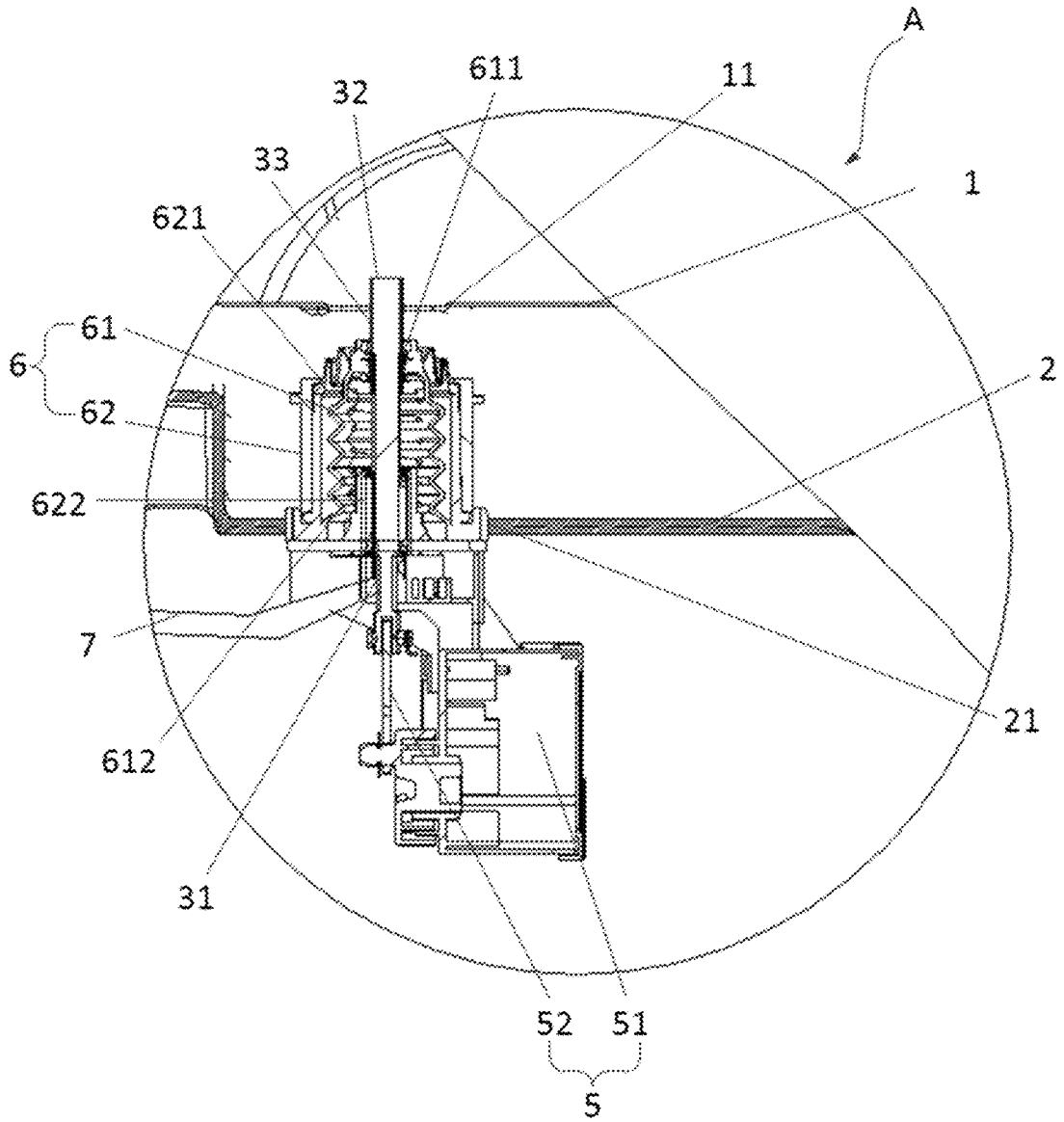
FIG. 3 is a partially enlarged view of a part denoted by A in FIG. 2.

As shown in FIGS. 2 and 3, it is possible that the ventilation member 3 is a rod 33, and an airflow channel is formed inside the rod 33 in its axial direction; the gas inlet 31 and the gas outlet 32 are both communicated with the airflow channel. The driving device 5 includes a motor 51 and a transmission assembly (such as a cam and connecting rod mechanism 52 described below), and the motor 51 is connected to the rod 33 through the transmission assembly to drive the rod 33 to extend and retract on inner and outer sides of the ventilation hole 11. A first installation hole 21 is provided on the outer cylinder 2 of the clothing treatment apparatus, and the clothing treatment apparatus further includes a sealing member 6. The sealing member 6 includes a flexible cover 61, a bottom end of the flexible cover 61 has an opening, and the opening 612 is sealingly connected to the first installation hole 21. A top end of the flexible cover 61 is provided with a second installation hole 611; a first end of the rod 33 is connected to the transmission assembly, a second end of the rod 33 is arranged in such a way that it passes through the second installation hole 611 from an interior of the flexible cover 61, and the second installation hole 611 is fixedly and sealingly connected to the rod 33. When the driving device 5 drives the rod 33 to extend into the inner side of the ventilation hole 11 (i.e., the interior of the inner cylinder 1), the flexible cover can form a seal with the ventilation hole 11. It can be understood that the flexible cover 61 is a flexible cover body having a cavity formed in its interior, and the bottom end thereof has an opening. The opening 612 is communicated with the cavity, and the opening 612 is sealingly connected to the first installation hole 21. The top end of the flexible cover 61 refers to a side away from the opening 612. A cover wall of the flexible cover 61 is preferably corrugated, and of course it can also be non-corrugated. The material of the flexible cover 61 can be rubber or silicone, etc. The second installation hole 611 can be fixedly sealed with the rod 33 in various ways, such as through interference fit between the second installation hole 611 and the rod 33, or through sealing gasket connection. In addition, the gas inlet 31 of the rod 33 can be located at the first end thereof or on the side wall thereof; the gas outlet 32 of the rod 33 is preferably located at the second end thereof, and of course can also be located on the side wall thereof. In this case, in order to effectively ensure that the rod 33 can extend and retract, the connecting pipe 7 connected to the gas vent 41 of the gas generation device 4 can be a corrugated pipe, or a flexible hose that can be deformed.

When it is necessary to introduce gas into the water storage area of the inner cylinder 1, the driving device 5 drives the rod 33 to extend from the ventilation hole 11 to the water storage area of the inner cylinder 1. At this time, due to the fixed sealing connection between the rod 33 and the second installation hole 611, when the rod 33 extends in a straight line toward the ventilation hole 11, it will drive the flexible cover 61 to move together toward the ventilation hole 11 until the flexible cover 61 abuts against the ventilation hole 11, thereby forming a seal between the flexible cover 61 and the ventilation hole 11, and preventing the gas introduced into the water storage area from escaping between the inner cylinder 1 and the outer cylinder 2 from the ventilation hole 11, which would otherwise result in a loss in bubble amount. Especially, when there is a large amount of clothing in the inner cylinder 1, the deterioration of washing effect can be avoided. In addition, due to the sealing between the bottom end of the flexible cover 61 and the first installation hole 21, the washing water can be prevented from flowing out of the first installation hole 21. Through the above arrangement, the flexible cover 61 can be simultaneously sealed with both the ventilation hole 11 and the first installation hole 21, so that one component can be used for multiple purposes and usage cost can be lowered.

Further, the sealing member 6 further includes a casing 62 having an opening 621 at a top end, and a bottom end of the casing 62 is sealingly installed in the first installation hole 21. The sealing connection can be achieved in various ways, such as through interference fit between the casing 62 and the first installation hole 21, or through a sealing gasket, etc. The bottom end of the flexible cover 61 is connected to an inner bottom wall of the casing 62, and the top end of the flexible cover 61 is sealingly connected to the opening 621, such as through a corrugated rubber body or a flat silicone gel body. A second through hole 622 is also formed on the inner bottom wall of the casing 62, and the second through hole 622 is provided in the flexible cover 61. The rod 33 passes through the second through hole 622, and leaves a free gap with the second through hole 622 to allow the rod 33 to move in the second through hole 622.

The bottom end of the flexible cover 61 is sealingly connected to the first installation hole 21 through the bottom wall of the casing 62, so that the washing water can be prevented from flowing out of the first installation hole 21. The top end of the flexible cover 61 is sealingly connected to the opening 621, so that the washing water can be prevented from entering the interior of the casing 62, ensuring that internal parts will not be in contact with the washing water for a long term, protecting the internal parts from damage, and improving their service life. The arrangement of the second through hole 622 on the bottom wall of the casing 62 can define the linear movement of the rod 33, achieving precise insertion of the rod 33 into the ventilation hole 11. The above overall design of the sealing member 6 requires less structural modifications to the inner cylinder 1 and the outer cylinder 2, and facilitates assembly and disassembly. Further, the flexible cover 61 is also internally provided with a spring, one end of which is connected to the inner top wall of the flexible cover 61, and the other end of which is connected to the inner bottom wall of the casing 62, thereby achieving support for the flexible cover 61.

Possibly, the transmission assembly is a cam and connecting rod mechanism 52, that is, the motor 51 is connected to the first end of the rod 33 through the cam and connecting rod mechanism 52. It can be understood that the cam and connecting rod mechanism 52 includes a cam and a connecting rod. An output shaft of the motor 51 is fixedly connected to the cam, and the cam is hinged to the connecting rod. The connecting rod is hinged to the first end of the rod 33, so that when the output shaft of the motor 51 rotates, it can drive the rod 33 to move in a straight line, thus achieving the extending and retracting of the rod 33 on inner and outer sides of the ventilation hole 11. The gas inlet 31 of the ventilation member 3 can be arranged on the side wall of the rod 33, and the end of the rod 33 that is away from the inner cylinder 1 is not provided with an opening, and is hinged to the connecting rod. There are many ways to fix the motor 51; for example, a bracket can be arranged on the outer side wall or housing of the outer cylinder 2, and the motor 51 can be fixedly arranged on the bracket; alternatively, the motor 51 can be directly arranged on the inner wall of the housing or the outer wall of the outer cylinder 2, etc.

Figure 4:
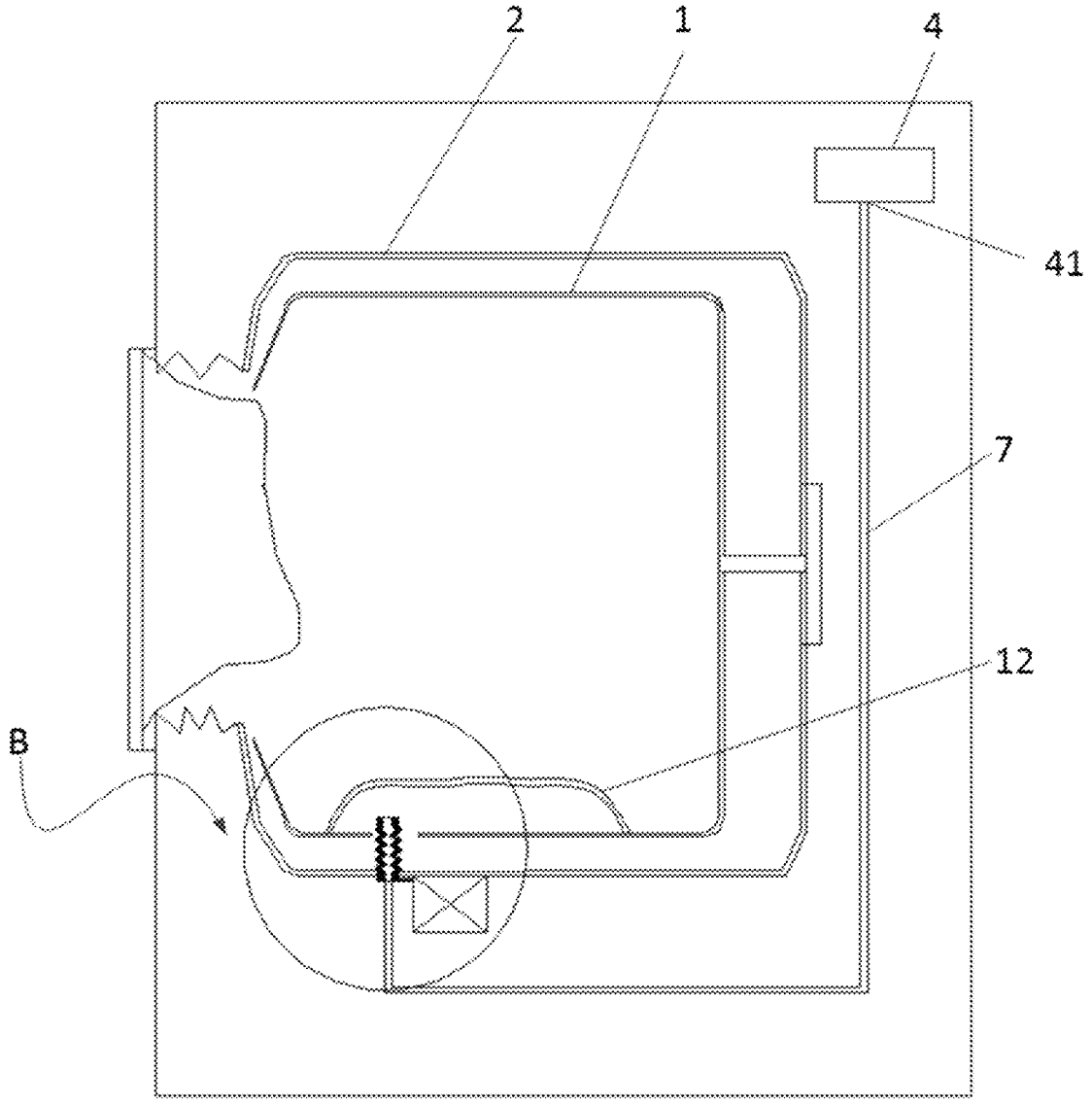
FIG. 4 is a second schematic structural view of a possible embodiment of the clothing treatment apparatus and the control method for the clothing treatment apparatus of the present disclosure.
Figure 5:
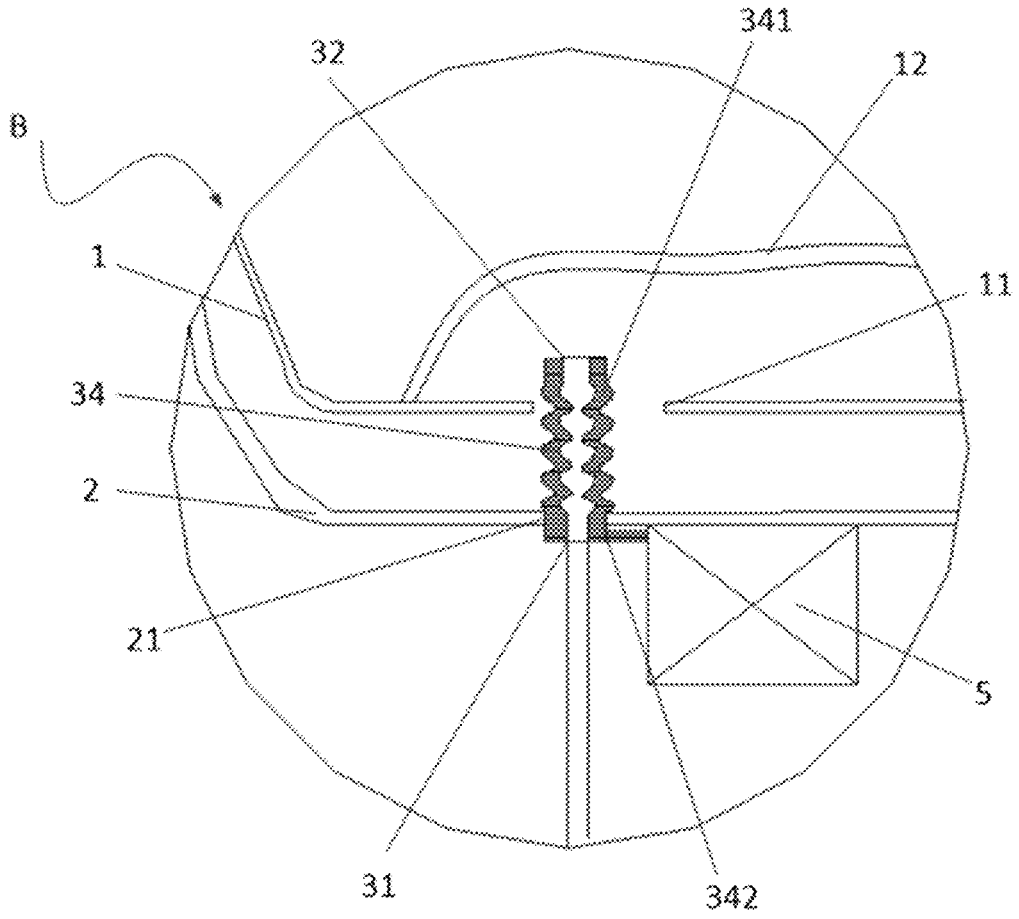
FIG. 5 is a partially enlarged view of a part denoted by B in FIG. 4.
Figure 6:
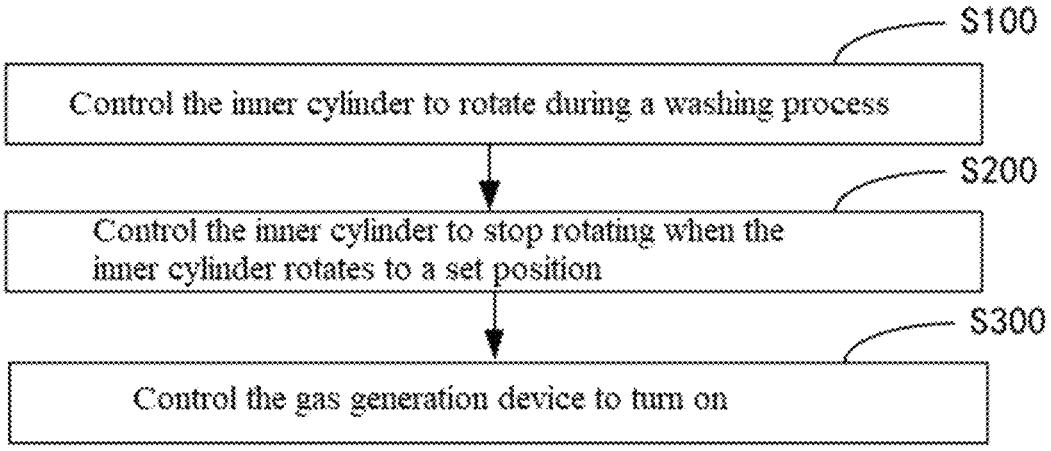
FIG. 6 is a flowchart of the main steps of the control method for the clothing treatment apparatus of the present disclosure.

In addition, the implementations of the driving device 5 driving the ventilation member 3 to extend and retract on inner and outer sides of the ventilation hole 11 are not limited to the above implementations. For example, as shown in FIGS. 4 and 5, it is possible that the ventilation member 3 is a corrugated pipe 34, and a pressure chamber 341 is formed inside a pipe wall of the corrugated pipe 34. A pressure port 342 is provided on the pipe wall, and the pressure port 342 is communicated with the pressure chamber 341. The driving device 5 is a pneumatic or hydraulic device, and an outlet of the driving device 5 is communicated with the pressure port 342. One end of the corrugated pipe 34 is communicated with the gas vent 41, and in this case, the other end of the corrugated pipe 34 is the gas outlet 32 thereof.

There are various types of the specific forms of the pneumatic device. For example, it can be an air pump or any existing or future possible device that can suck and blow air. The hydraulic device may include a bidirectional hydraulic pump and a hydraulic box. An outlet of the hydraulic box is connected to a first opening of the bidirectional hydraulic pump, and a second opening of the hydraulic pump is connected to the pressure port 342. That is, when hydraulic oil needs to be injected, the bidirectional hydraulic pump acts, causing the hydraulic oil in the hydraulic box to flow into the pressure chamber 341 through the first opening, the second opening, and the pressure port 342. When the hydraulic oil needs to be discharged, the bidirectional hydraulic pump acts, causing the hydraulic oil to flow back into the hydraulic box through the pressure port 342, the second opening, and the first opening in sequence. Alternatively, the hydraulic device can be a piston type hydraulic cylinder, which includes a cylinder body, a piston, a connecting rod, and a driving member. An oil hole and an installation hole are provided on the cylinder body, and the oil hole is connected to the pressure port 342. The piston is located in the cylinder body and can sealingly slide in an axial direction of the cylinder body. An empty chamber in the cylinder body is divided into a first chamber and a second chamber. The oil hole is located in the first chamber, and the installation hole is located in the second chamber and is arranged at the end of the cylinder body. One end of the connecting rod is connected to the piston, and the other end of the connecting rod passes through the installation hole and is connected to the driving member outside the cylinder body. The hydraulic oil is accommodated in the first chamber, and the driving member is any device that can drive the piston to perform linear movement through the connecting rod, such as the combination of motor and rack-and-pinion, etc. When the driving member drives the piston to move toward the first chamber, the volume of the first chamber decreases, and the hydraulic oil is discharged from the oil hole into the pressure chamber 341. When the driving member drives the piston to move toward the second chamber, the volume of the first chamber increases, and the hydraulic oil in the pressure chamber 341 is sucked back into the first chamber through the oil hole. Alternatively, the hydraulic device can also be any existing or future possible device that can achieve oil discharge and oil suction.

In addition, it can be understood that the pipe wall of the corrugated pipe 34 of the present disclosure can be entirely corrugated or partially corrugated; for example, a middle part thereof is corrugated, and pipe surfaces at both ends are flat. There are various ways to sealingly arrange the corrugated pipe 34 in the first installation hole 21; for example, one end of the corrugated pipe 34 is not corrugated, and a circular metal sheet is fastened and sleeved on the periphery of this end. The first installation hole 21 on the outer cylinder 2 is sealingly connected to the metal sheet through a sealing gasket. Alternatively, the corrugated pipe 34 is directly connected to the first installation hole 21 through waterproof adhesive, etc. The corrugated pipe 34 can be arranged to extend out of the first installation hole 21, and the pressure port 342 is located on the pipe wall on the outer side of the first installation hole 21, thereby facilitating the connection between the pressure port 342 and the outlet of the driving device 5.

When it is necessary to introduce gas into the water storage area of the inner cylinder 1, the pneumatic or hydraulic device acts, causing the gas or hydraulic oil to enter the pressure chamber 341 of the corrugated pipe 34 through the pressure port 342, achieving pressurization inside the pressure chamber 341, so that the corrugated pipe 34 begins to stretch, and can further extend into the ventilation hole 11. When it is not necessary to introduce gas into the water storage area of the inner cylinder 1, the pneumatic or hydraulic device performs a pressure relief operation, causing the gas or hydraulic oil in the pressure chamber 341 to be discharged through the pressure port 342, so that pressure inside the pressure chamber 341 is relieved and the corrugated pipe 34 can retract to the outside of the inner cylinder 1 to avoid interference.

In this case, the above flexible cover can also be further provided, that is, the opening at the bottom end of the flexible cover is sealingly connected to the first installation hole 21; one end of the corrugated pipe 34 is sealingly connected to the first installation hole 21, the other end of the corrugated pipe 34 passes through the second installation hole 611 at the top end of the flexible cover from the interior of the flexible cover, and the second installation hole 611 is sealingly connected to the corrugated pipe 34. When the driving device 5 drives the corrugated pipe 34 to extend into the inner side of the ventilation hole 11, the flexible cover can form a seal with the ventilation hole 11, so as to prevent the gas introduced into the water storage area from escaping between the inner cylinder 1 and the outer cylinder 2 from the ventilation hole 11, which would otherwise result in a loss in bubble amount.

As a preferred embodiment, a lifting rib 12 is provided on the inner side wall of the inner cylinder 1, and a first through hole is provided on the lifting rib 12; the lifting rib 12 and the inner side wall enclose a chamber, in which the ventilation hole 11 is located. It can be understood that the function of the lifting rib 12 is to lift the clothing to a higher position when the inner cylinder 1 rotates, beating the clothing up and down, and achieving the purpose of washing the clothing clean.

Referring to FIG. 1, the present disclosure utilizes the original structure of the clothing treatment apparatus, i.e., the lifting rib 12, so that after the ventilation member 3 is inserted into the water storage area of the inner cylinder 1 from the ventilation hole 11, since the ventilation hole 11 is located in the chamber enclosed by the lifting rib 12 and the inner side wall of the inner cylinder 1, the clothing can be prevented from contacting the ventilation member 3, thus avoiding interference between the ventilation member 3 and the clothing, and further avoiding possible wear of the ventilation member 3 and damage of the clothing. In addition, due to the small enclosed space formed by the lifting rib 12 and the inner side wall of the inner cylinder 1, the energy loss of bubbles is relatively small. Therefore, the bubbles can still reach the clothing through the first through hole provided on the lifting rib 12 to form cavitation bubbles, thus efficiently removing dirt from the clothing.

In a second possible embodiment, the gas outlet 32 of the ventilation member 3 is located between the inner cylinder 1 and the outer cylinder 2, and is arranged corresponding to the ventilation hole 11, that is, the gas enters the water storage area of the inner cylinder 1 directly through the ventilation hole 11 from the gas outlet 32 of the ventilation member 3.

There are various types of the specific forms of the ventilation member 3; for example, it can be a hollow rod, one end of which (the gas inlet 31) is communicated with the gas vent 41 of the gas generation device 4, and the other end of which is the gas outlet 32, and the gas outlet 32 is arranged corresponding to the ventilation hole 11. Alternatively, the ventilation member 3 can be a connecting pipe 7 directly connected to the gas vent 41 of the gas generation device 4; one end of the gas outlet of the connecting pipe 7 extends between the inner cylinder 1 and the outer cylinder 2 directly from the first installation hole 21, and is arranged corresponding to the ventilation hole 11. The above ventilation member 3 can be directly sealingly connected to the first installation hole 21 through a sealing gasket. Alternatively, the ventilation member 3 is the first installation hole 21, which is arranged corresponding to the ventilation hole 11. In this case, the first installation hole 21 extends by a preset length from the inner wall of the outer cylinder 2 to the side of the inner cylinder 1, and the gas vent 41 of the gas generation device 4 is sealingly connected to the first installation hole 21. When the ventilation member 3 is the connecting pipe 7 directly connected to the gas vent 41 of the gas generation device 4, it is possible for the connecting pipe 7 to not extend from the first installation hole 21, but from a hole arranged on a window gasket at which the outer cylinder opening is connected with the housing, forming an effective seal. Then, the gas outlet 32 of the connecting pipe 7 is arranged corresponding to the ventilation hole 11. In this case, the ventilation hole 11 can be arranged on a front side of the inner cylinder 1, such as at the inner cylinder opening.

Through the above arrangement, the washing effect is only slightly weakened, but it is possible to avoid interference between the ventilation member 3 and the clothing, and avoid wear of the ventilation member 3 and damage of the clothing. In addition, the arrangement of the driving device 5 can be omitted, so that the usage cost is lowered. In addition, this arrangement will not hinder the rotation of the inner cylinder 1. When the inner cylinder 1 rotates, the gas generation device 4 can be always activated. When the gas outlet 32 of the ventilation member 3 is opposite to the ventilation hole 11 of the inner cylinder 1, the best ability of removing clothing stains is achieved.

As a possible embodiment, the clothing treatment apparatus further includes a position sensing device which is set to be triggered when the inner cylinder 1 rotates to a set position, so as to control the inner cylinder 1 to stop rotating, so that after the inner cylinder 1 stops rotating, the gas generated by the gas generation device 4 can enter the water storage area of the inner cylinder 1 through the ventilation hole 11 from the gas outlet 32.

The above set position can be the position when the ventilation hole 11 is opposite to the gas outlet 32. In this case, the rotational speed of the inner cylinder 1 has to be slow. After the position sensing device is triggered, it will send a trigger signal so that a controller of the clothing treatment apparatus receives the trigger signal. After receiving the trigger signal, the controller controls the inner cylinder 1 to stop rotating. At this time, since the rotational speed of the inner cylinder 1 is relatively slow, the inner cylinder 1 can almost stop rotating immediately, ensuring that the ventilation hole 11 is opposite to the gas outlet 32, and further ensuring that the ventilation member 3 extends from the ventilation hole 11 into the interior of the inner cylinder 1 or that the gas outlet 32 between the inner cylinder 1 and the outer cylinder 2 is aligned with the ventilation hole 11 of the inner cylinder 1. When the rotational speed of the inner cylinder 1 is relatively fast, the above set position is where the inner cylinder 1 rotates to a position which is a preset distance in front of the position where the ventilation hole 11 is opposite to the gas outlet 32, that is, when the inner cylinder 1 rotates to the position which is a preset distance in front of the position where the ventilation hole 11 is opposite to the gas outlet 32, the position sensing device is triggered to send a trigger signal. After the controller receives the trigger signal, it controls the inner cylinder 1 to stop rotating. After the inner cylinder 1 stops rotating, due to the relatively high speed of the inner cylinder 1, the inner cylinder 1 will continue rotating for a preset distance and stop rotating after the inner cylinder 1 has rotated for the preset distance. At this time, the ventilation hole 11 is right opposite to the gas outlet 32, ensuring that the ventilation member 3 can extend from the ventilation hole 11 into the interior of the inner cylinder 1 or that the gas outlet 32 between the inner cylinder 1 and the outer cylinder 2 is right opposite to the ventilation hole 11 of the inner cylinder 1, and further ensuring that gas enters the water storage area of the inner cylinder 1 through the ventilation hole 11.

There are various types of the specific forms of the position sensing device. For example, the position sensing device includes a Hall sensor and a magnet. The Hall sensor is arranged on the outer wall of the outer cylinder 2, and the magnet is arranged on the outer wall of the inner cylinder 1. When the inner cylinder 1 rotates to the set position, the position of the Hall sensor is opposite to the position of the magnet to trigger the signal. Alternatively, the Hall sensor is arranged on the outer bottom wall of the outer cylinder 2 (at the bottom side in the axial direction of the outer cylinder), and the magnet is arranged on an outer rotor of a direct drive motor that drives the inner cylinder 1 to rotate. When the inner cylinder 1 rotates to the set position, the position of the Hall sensor is opposite to the position of the magnet to trigger the signal. Alternatively, the position sensor includes a signal switch and a signal contact, with the signal switch being arranged at the outer cylinder opening, and the signal contact being arranged at the inner cylinder opening. When the inner cylinder 1 rotates to the set position, the signal switch contacts the signal contact to trigger the signal.

In addition, the present disclosure also provides a control method for a clothing treatment apparatus, and the control method includes:

Step S100: controlling the inner cylinder to rotate during a washing process.

Step S200: controlling the inner cylinder to stop rotating when the inner cylinder rotates to a set position.

Step S300: controlling the gas generation device to turn on.

A bubble program can be added to the washing program of the clothing treatment apparatus to introduce gas into the inner cylinder. For example, in the washing program of the clothing treatment apparatus, the motor that controls the rotation of the inner cylinder will rotate according to a preset rotation-to-stop ratio. Therefore, in the washing program, when the motor that runs according to the preset rotation-to-stop ratio is in a stop-rotating interval, the bubble program can be executed; that is, the inner cylinder is controlled to rotate until the inner cylinder rotates to a set position, then the inner cylinder is controlled to stop rotating, and after the inner cylinder stops rotating, the gas generation device is controlled to turn on, so as to introduce gas into the water storage area of the inner cylinder and improve the washing effect. The set position is the set position introduced in the above embodiment, and there are various ways to determine that the inner cylinder has rotated to the set position, such as by providing the position sensing device described above; when the inner cylinder rotates to the set position can also be determined based on the rotational speed and duration of the motor that drives the inner cylinder to rotate; that is, the rotational speed and duration of the motor determine the rotational position of the inner cylinder. Therefore, when the rotational speed and duration of the motor both reach set values respectively, it can be determined that the inner cylinder has rotated to the set position.

When the gas outlet is located between the inner cylinder and the outer cylinder and arranged corresponding to the ventilation hole, after the inner cylinder is controlled to stop rotating, the gas generation device can be directly controlled to turn on, so that most of the gas enters the water storage area of the inner cylinder through the gas outlet of the ventilation member and the ventilation hole of the inner cylinder in sequence, so as to improve the washing effect.

When the clothing treatment apparatus further includes a driving device, the driving device is connected to the ventilation member, and the ventilation member can extend and retract on inner and outer sides of the ventilation hole when driven by the driving device. After the step of "controlling the inner cylinder to stop rotating", the method also includes a step of "controlling the driving device to drive the ventilation member to extend into the inner side of the ventilation hole", and then the gas generation device is controlled to turn on, so that the gas is directly introduced into the water storage area of the inner cylinder through the gas outlet of the ventilation member, improving the stain removing ability and washing effect. After the step of "controlling the gas generation device to turn on", the method also includes a step of "controlling the driving device to drive the ventilation member to retract to the outer side of the ventilation hole after a preset time has elapsed", in which the preset time mentioned above can be set by users, or calculated based on a preset time period before rotation of the inner cylinder that runs according to the preset rotation-stop-ratio in the original washing program of the washing machine. That is, within the preset time before rotation of the inner cylinder that runs according to the original washing program of the washing machine, the driving device is controlled to drive the ventilation member to retract to the outer side of the ventilation hole, so that after bubble washing of the clothing is completed, there will be no interfere with the rotation of the inner cylinder, thus completing efficient washing of the clothing.

It should be noted that the above embodiments are only used to illustrate the principle of the present disclosure, and are not intended to limit the scope of protection of the present disclosure. Without deviating from the principle of the present disclosure, those skilled in the art can adjust the above embodiments so that the present disclosure can be applied to more specific application scenes.

For example, although the present disclosure is described in connection with a flexible cover, it is not intended to limit the scope of protection of the present disclosure. The arrangement can be adjusted, such as omitting the arrangement of the flexible cover. The first end of the rod 33 is connected to the first installation hole through a flexible sealing gasket, that is, the flexible sealing gasket compensates for the movement distance of the rod 33. All of these do not deviate from the principle of the present disclosure and are within the scope of protection of the present disclosure.

For example, although the present disclosure is described using an example in which a second through hole 622 is formed on the bottom wall of the casing 62, the second through hole 622 is provided in the flexible cover 61, the rod 33 passes through the second through hole 622 and leaves a free gap with the second through hole 622, this is not intended to limit the scope of protection of the present disclosure. For example, the arrangement of the casing 62 can be omitted, the rod 33 can pass through the first installation hole 21, the first installation hole 21 can leave a free gap with the rod 33, and a bottom sealing cover of the flexible cover 61 is arranged on the periphery of the first installation hole 21, etc., all of which do not deviate from the principle of the present disclosure and are within the scope of protection of the present disclosure.

For example, as an alternative embodiment, although the driving device 5 of the present disclosure is described in connection with a motor 51 and a cam and connecting rod mechanism 52, this is not intended to limit the scope of protection of the present disclosure. The arrangement can be adjusted. For example, the driving device 5 can be a motor 51 and a rack-and-pinion mechanism, an output shaft of the motor 51 is fixedly connected to the pinion, the pinion meshes with the rack, and the rack is connected to the first end of the rod 33. A guide member can be provided on the outer side wall of the outer cylinder 2, a strip-shaped groove can be provided on the guide member, and the rack is movably arranged in the groove so that the rack can be guided, etc. In this case, the rod 33 may not be sealingly connected to the first installation hole 21; rather, it is the rack that is sealingly connected to the first installation hole 21. All of the above changes do not deviate from the principle of the present disclosure and are within the scope of protection of the present disclosure.

It can be understood by those skilled in the art that the above clothing treatment apparatus includes some other well-known structures, such as a processor, a controller, a memory, etc. The memory includes but is not limited to a random access memory, a flash memory, a read-only memory, a programmable read-only memory, a volatile memory, a non-volatile memory, a serial memory, a parallel memory or a register, etc. The processor includes but is not limited to CPLD/FPGA, DSP, ARM processor, MIPS processor, etc. In order not to unnecessarily obscure the embodiments of the present disclosure, these well-known structures are not shown in the accompanying drawings.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment apparatus, comprising:

an inner cylinder, on which a ventilation hole is provided;

a ventilation member, which comprises a gas inlet and a gas outlet; and a gas generation device, which comprises a gas vent; wherein the gas generation device is an air pump, a fan, or a compressor, the gas vent is communicated with the gas inlet, and gas generated by the gas generation device enters a water storage area of the inner cylinder through the ventilation hole from the gas outlet;

wherein the clothing treatment apparatus further comprises a driving device, which is connected to the ventilation member; the driving device comprising a motor and a transmission assembly; the ventilation member can extend and retract on inner and outer sides of the ventilation hole when driven by the driving device; wherein when the ventilation member extends into the inner side of the ventilation hole, the gas outlet is located in the water storage area.

2. The clothing treatment apparatus according to claim 1, wherein a lifting rib is provided on an inner side wall of the inner cylinder, and a first through hole is provided on the lifting rib; the lifting rib and the inner side wall enclose a chamber, in which the ventilation hole is located.

3. The clothing treatment apparatus according to claim 1, wherein the ventilation member is a rod, and an airflow channel is formed inside the rod in its axial direction; the gas inlet and the gas outlet are both communicated with the airflow channel; and the motor is connected to the rod through the transmission assembly.

4. The clothing treatment apparatus according to claim 3, wherein a first installation hole is provided on an outer cylinder of the clothing treatment apparatus, and the clothing treatment apparatus further comprises a sealing member; the sealing member comprises a flexible cover, a bottom end of the flexible cover has an opening, and the opening is sealingly connected to the first installation hole; a top end of the flexible cover is provided with a second installation hole; a first end of the rod is connected to the transmission assembly, a second end of the rod is arranged in such a way that it passes through the second installation hole from an interior of the flexible cover, and the second installation hole is fixedly and sealingly connected to the rod; when the driving device drives the rod to extend into the inner side of the ventilation hole, the flexible cover can form a seal with the ventilation hole.

5. The clothing treatment apparatus according to claim 4, wherein the sealing member further comprises a casing having an opening at a top end, and a bottom end of the casing is sealingly installed in the first installation hole; the bottom end of the flexible cover is connected to an inner bottom wall of the casing, and the top end of the flexible cover is sealingly connected to the opening at the top end of the casing; a second through hole is also formed on the bottom wall of the casing, and the second through hole is located in the flexible cover; the rod passes through the second through hole and leaves a free gap with the second through hole; and/or the transmission assembly is a cam and connecting rod mechanism.

6. The clothing treatment apparatus according to claim 1, wherein the clothing treatment apparatus further comprises a position sensing device comprising a Hall sensor and a magnet, the position sensing device is set to be triggered when the inner cylinder rotates to a set position, so as to control the inner cylinder to stop rotating, so that after the inner cylinder stops rotating, the gas generated by the gas generation device can enter the water storage area of the inner cylinder through the ventilation hole from the gas outlet.

7. The clothing treatment apparatus according to claim 4, wherein the gas outlet is located between the inner cylinder and the outer cylinder of the clothing treatment apparatus, and is arranged corresponding to the ventilation hole.

8. A control method for a clothing treatment apparatus, wherein the clothing treatment apparatus comprises:

an inner cylinder, on which a ventilation hole is provided;

a ventilation member, which comprises a gas inlet and a gas outlet; and a gas generation device, which comprises a gas vent; wherein the gas generation device is an air pump, a fan, or a compressor, the gas vent is communicated with the gas inlet, and gas generated by the gas generation device enters a water storage area of the inner cylinder through the ventilation hole from the gas outlet; and the control method comprises:

controlling the inner cylinder to rotate during a washing process;

controlling the inner cylinder to stop rotating when the inner cylinder rotates to a set position;

driving the ventilation member to extend into the inner side of the ventilation hole via a driving device comprising a motor and a transmission assembly; and controlling the gas generation device to turn on.

* * * * *